US007331258B1

(12) United States Patent
Hsieh

(10) Patent No.: US 7,331,258 B1
(45) Date of Patent: Feb. 19, 2008

(54) TIRE-ASSEMBLY SPANNER

(76) Inventor: Chih-Ching Hsieh, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 11/581,270

(22) Filed: Oct. 16, 2006

(51) Int. Cl.
*B25B 13/46* (2006.01)
*B25B 13/00* (2006.01)

(52) U.S. Cl. ..... 81/63; 81/58.4; 81/60

(58) Field of Classification Search ..... 81/60–63, 81/58, 58.4
See application file for complete search history.

(56) References Cited

U.S. PATENT DOCUMENTS 5,339,711 A * 8/1994 Shu ..... 81/63
6,601,477 B2 * 8/2003 Huang ..... 81/60
6,951,154 B2 * 10/2005 Hsien ..... 81/60
7,066,056 B1 * 6/2006 Hsieh ..... 81/61
7,107,877 B2 * 9/2006 Lee ..... 81/63
2004/0129114 A1 * 7/2004 Chen ..... 81/63

* cited by examiner

*Primary Examiner*—Hadi Shakeri

(57) ABSTRACT

A tire-assembly spanner which comprises a hollow handle installed with a bending tube portion at one end thereof; another end of the handle being installed with a holding portion; an engaging element installed to one end of the resisting portion far away from the handle; one end of the engaging element having an engaging portion for receiving a sleeve; one end of the engaging element having a ratchet teeth portion corresponding to the resisting portion; an inner side of the ratchet teeth portion being formed with an annular ratchet teeth. A switch is installed in the bending tube portion. A resisting portion is formed between the bending tube portion and the engaging element; the resisting portion has a through hole for receiving a switch.

1 Claim, 6 Drawing Sheets

TIRE-ASSEMBLY SPANNER

FIELD OF THE INVENTION

The present invention relates to spanner, and particularly to a tire-assembly spanner, wherein the tire can be locked and detached quickly and the tire-assembly spanner is a bending ratchet spanner which can return to an original form bi-directionally.

BACKGROUND OF THE INVENTION

In locking or unlocking the screws of the car tires, a bending spanner is used. This is because the screws are installed in the recess of a tire. Thus the straight spanner can not be used since the spanner will has a side adhere to the tire rim and thus it can not be operated effectively.

A bending tube spanner has a bending portion and a head of the bending portion has a rectangular post for engaging with a sleeve. Then the sleeve will enter into the recess of the tire rim for engaging with a screw.

When a tire explodes, a jack is used to lift the tire upwards to leave from the ground with a distance. The elevation of the car from the ground is limited. Generally the bending spanner is very long. The limitation is not sufficient for a bending spanner to drive a screw of the tire effectively. As a result, the spanner only rotates through a very finite range, such as one half or one third of a turn before the hand of the operator contacts the ground. Thus the spanner must return and then the operation is repeated. As a result, the operation is tedious and is not effective.

SUMMARY OF THE INVENTION

Accordingly, the primary object of the present invention is to provide a tire-assembly spanner, wherein the tire can be locked and detached quickly and the tire-assembly spanner is a bending spanner ratchet spanner which can return to an original form bidirectionally.

To achieve above objects, the present invention provides a tire-assembly spanner which comprises a hollow handle installed with a bending tube portion at one end thereof; another end of the handle being installed with a holding portion; an engaging element installed to one end of the resisting portion far away from the handle; one end of the engaging element having an engaging portion for receiving a sleeve; one end of the engaging element having a ratchet teeth portion corresponding to the resisting portion; an inner side of the ratchet teeth portion being formed with an annular ratchet teeth. A switch is installed in the bending tube portion. A resisting portion is formed between the bending tube portion and the engaging element; the resisting portion has a through hole for receiving a switch. A rotary portion and a wheel is installed in the resisting portion; by switching the switch, the rotary portion and the wheel will be driven and thus control the buckle so as to form a bidirectional ratchet bending spanner. The wheel is formed with a trench for receiving a buckle.

The various objects and advantages of the present invention will be more readily understood from the following detailed description when read in conjunction with the appended drawing.

DETAILED DESCRIPTION OF THE INVENTION

Figure 1:
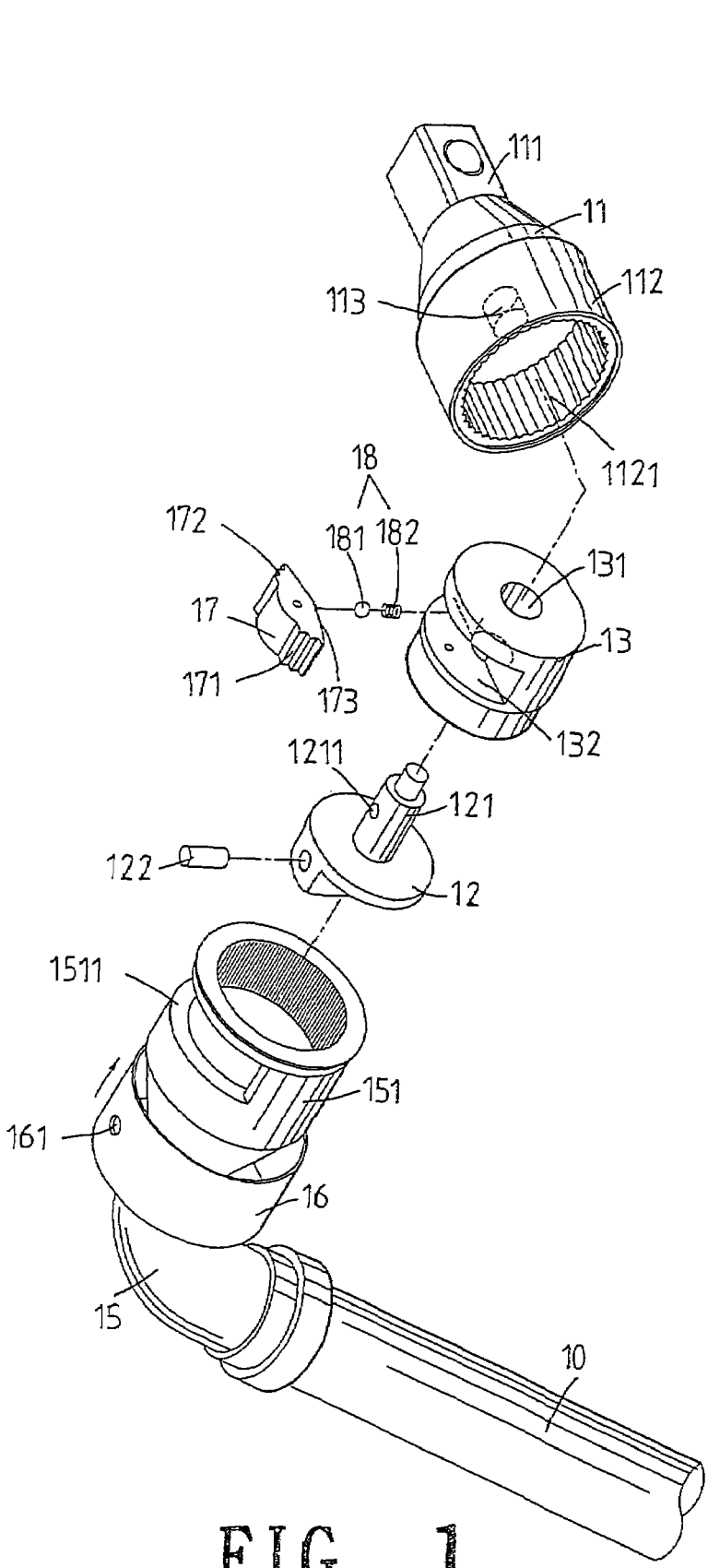
FIG. 1 shows the exploded perspective view of the tire-assembly spanner of the present invention.
Figure 2:
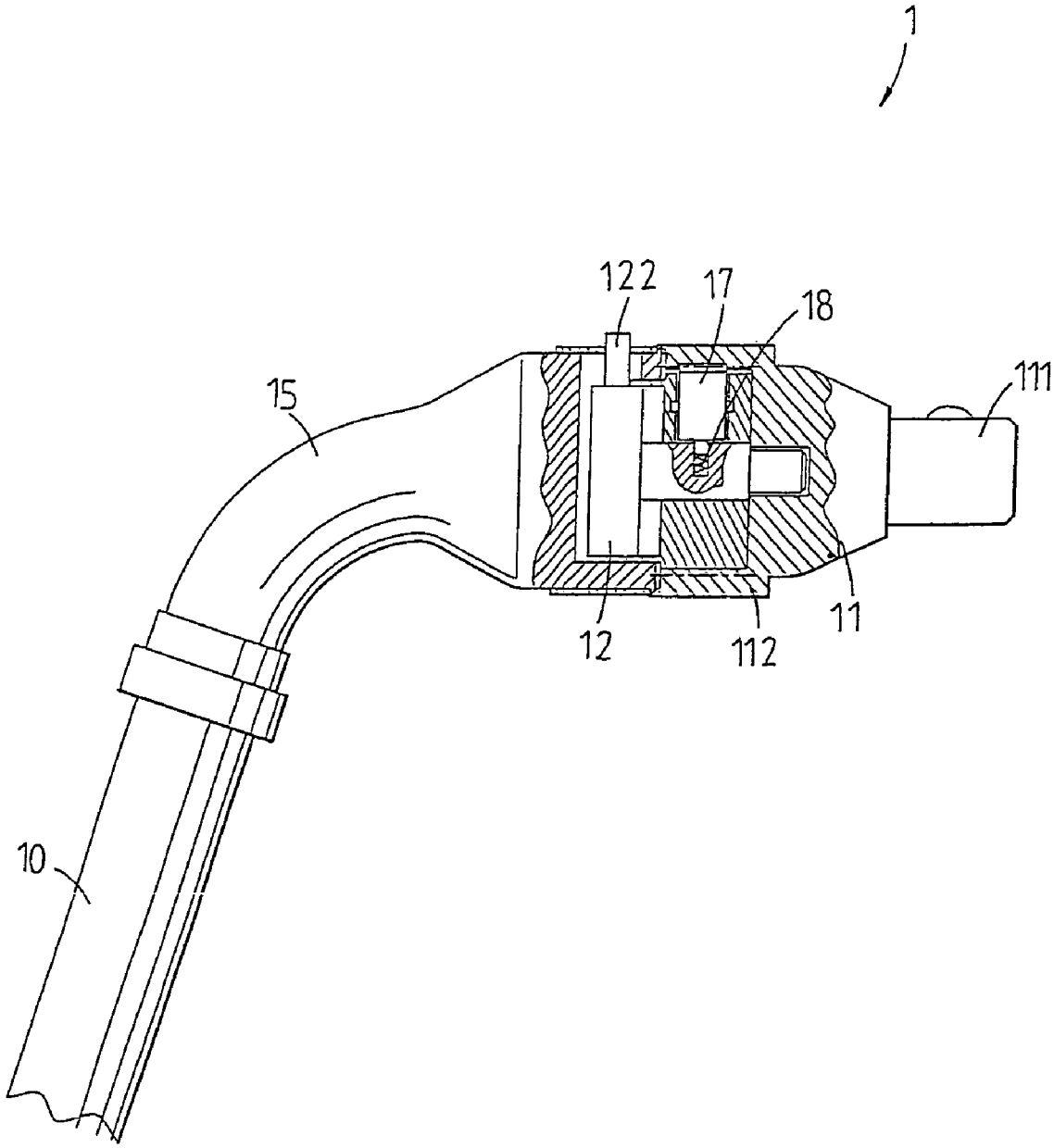
FIG. 2 is a cross sectional view of the tire-assembly spanner of the present invention.
Figure 3:
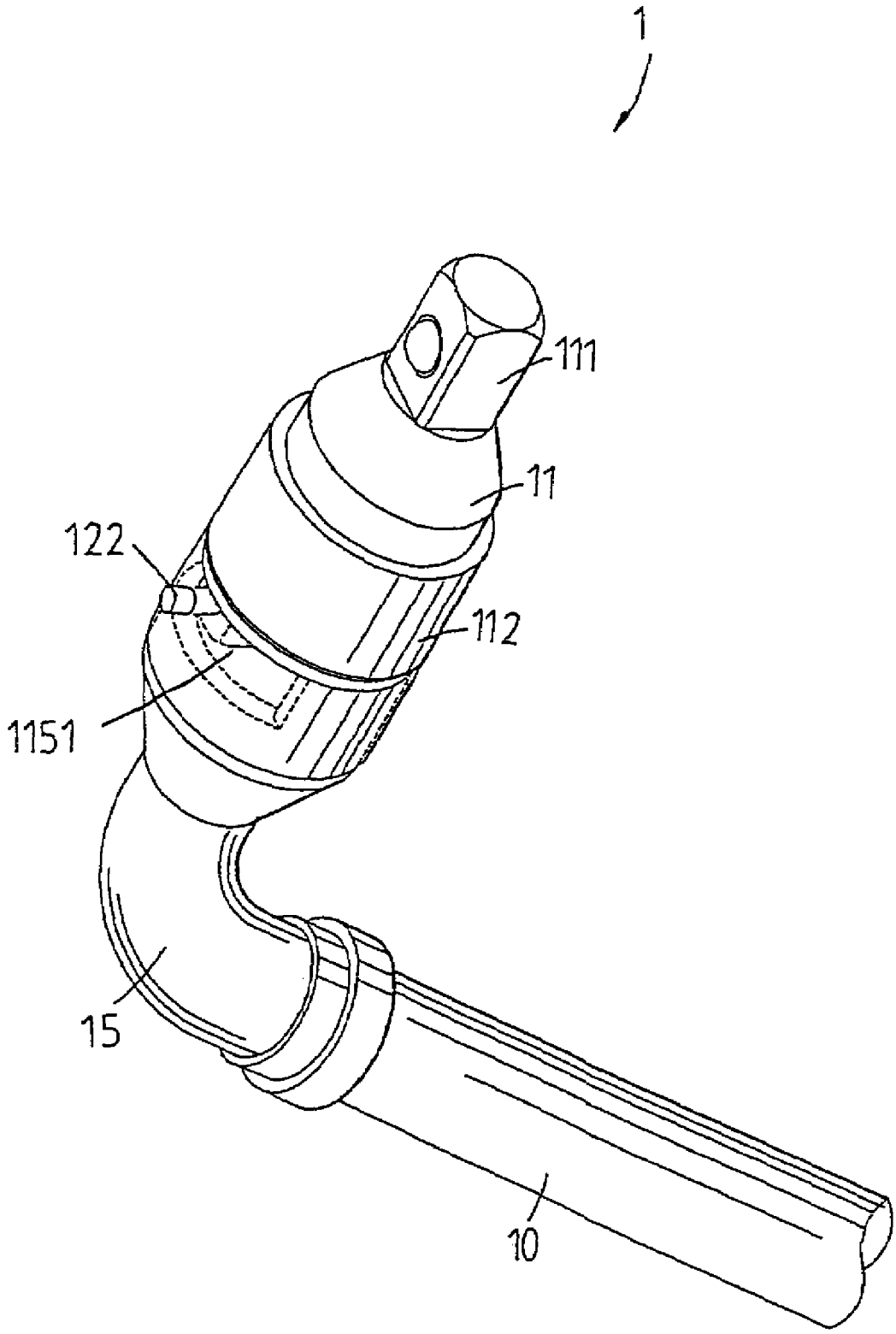
FIG. 3 is a partial schematic view about the tire-assembly spanner of the present invention.
Figure 4:
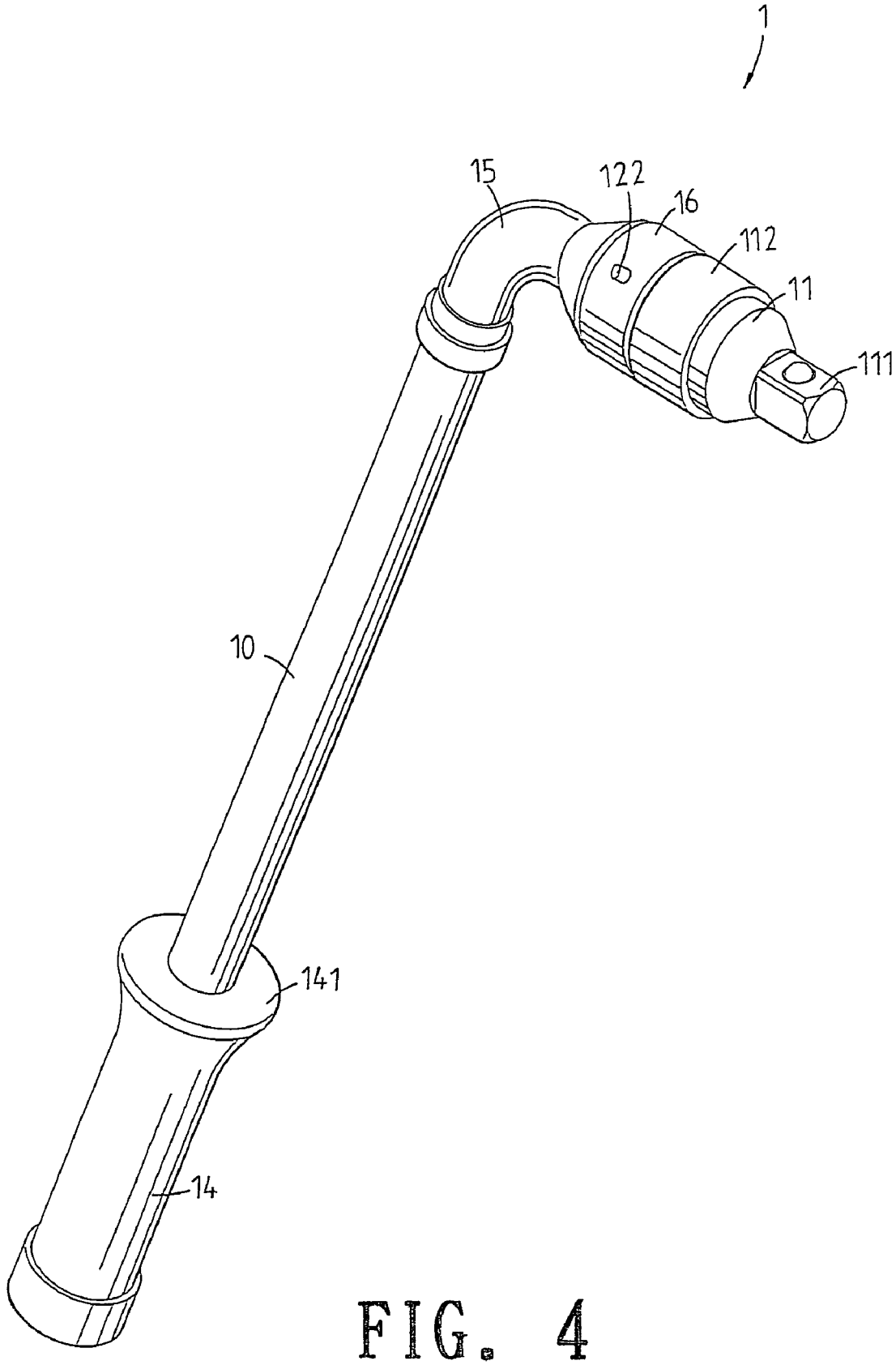
FIG. 4 is a schematic view about the tire-assembly spanner of the present invention.

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Referring to FIGS. 1 to 4, the tire-assembly spanner of the present invention is illustrated. The body 1 of the present invention has the following elements.

A hollow handle 10 is installed with a bending tube portion 15 at one end thereof. Another end of the handle 10 is installed with a holding portion 14. A front end of the holding portion 14 has a stop edge 141. An end of the bending tube portion 15 far away from the handle 10 has a resisting portion 151. A lateral side of the resisting portion 151 has a through hole 1511. A ring 16 encloses the resisting portion 151 and the ring 16 has a hole 161.

Figure 7:
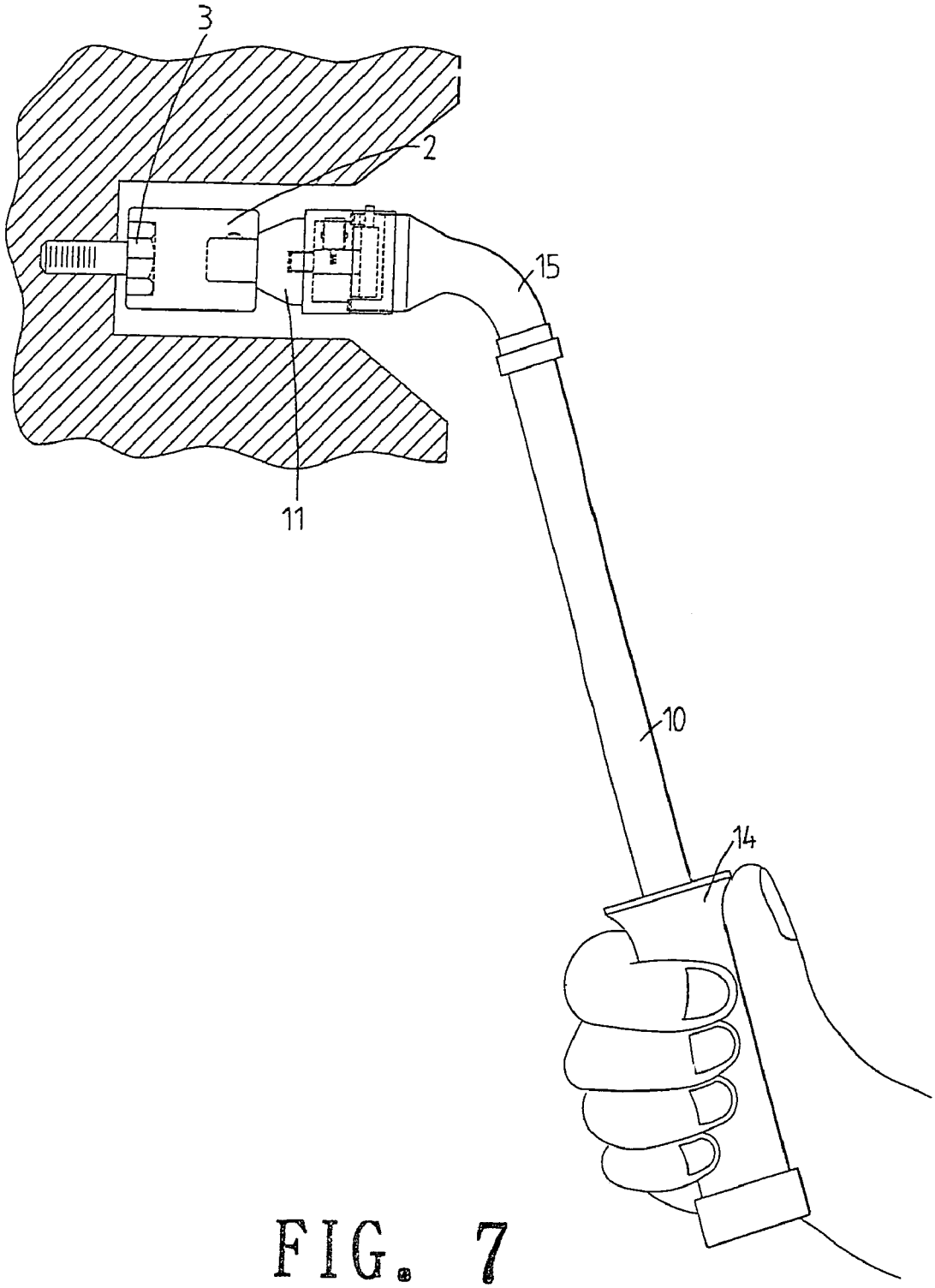
FIG. 7 is a schematic view about the operation of the tire-assembly spanner of the present invention.

An engaging element 11 is installed to one end of the resisting portion 151 far away from the handle 10. One end of the engaging element 11 has an engaging portion 111 for receiving a sleeve (FIG. 7). One end of the engaging element 11 has a ratchet teeth portion 112 corresponding to the resisting portion 151. An inner side of the ratchet teeth portion 112 is formed with an annular ratchet teeth 1121. An axial center of the engaging element 11 has a groove 113 for receiving a rotary portion 12.

One end of the rotary portion 12 is reduced as a shaft 121. A lateral side of the shaft 121 is formed with a recess 1211. A lateral side of the rotary portion 12 has a switch 122 which can be received in the through hole 1511 of the resisting portion 151 and the hole 161 of the ring 16.

A wheel 13 has a penetrating axial hole 131 for receiving the shaft 121. A lateral side of the wheel 13 has a trench 132 communicated to the axial hole 131 for receiving a buckle 17. Two ends of the buckle 17 are formed with a first teeth 171 and a second teeth 172. A side of the buckle 17 facing to the trench 132 is formed with two inclined surfaces 173. A control unit 18 is installed between the buckle 17 and the trench 132. The control unit 18 is formed by a steel ball 181 and an elastic body 182. The elastic body 182 is installed within the recess 1211 of the shaft 121. By rotating the switch 122, the control unit 18 swings so that the buckle 17 rotates at different directions. By the buckle 17 to resist against the ratchet teeth 1121 of the ratchet teeth portion 112, the body 1 can be driven bi-directionally.

Figure 5:
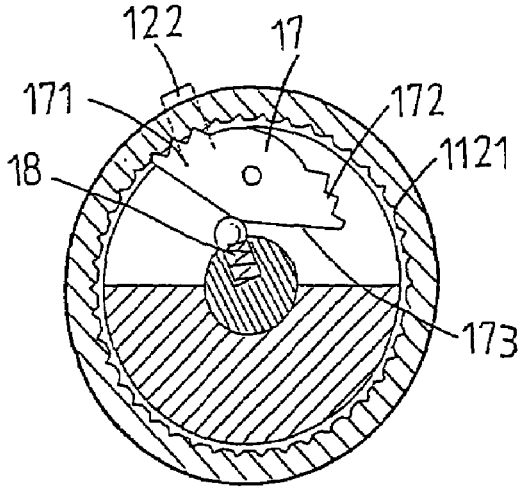
FIGS. 5 and 6 show the operation of the switch of the tire-assembly spanner of the present invention.
Figure 6:
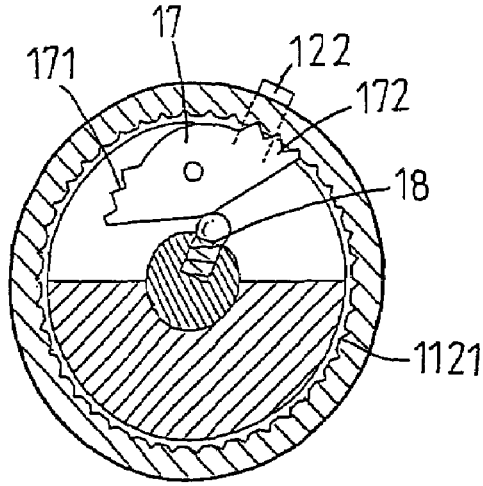

In use, referring to FIGS. 5 to 7, the engaging portion 111 is engaged with a sleeve 2, the switch 122 is switched so as to drive control unit 18 to move upwards along the inclined surfaces 173 of the buckle 17 so as to shift the buckle 17. When the first teeth 171 resists against the ratchet teeth 1121, the first teeth 171 is engaged to the ratchet teeth 1121 so as to drive the engaging element 11 and the sleeve 2. Thus, a screwing unit 3 can be screwed clockwise. Then the second teeth 172 resists against the ratchet teeth 1121. When the handle 10 rotates to resist an object, it is only necessary to rotate the handle 10 reversely, the first teeth 171 will jumps between the teeth. Therefore, the effect of returning the handle 10 is achieved. If it is desired to remove the screw unit 13, the switch 122 is switched to another direction. Then the second teeth 172 will resist against the ratchet teeth 1121. Then by moving the body 1, the screwing unit 3 can be removed.

In the present invention, by the bidirectional switch 122 in the resisting portion 151, it is unnecessary to perform the process of take outing and returning the bending tube portion 15 as the bending tube portion 15 is rotated to a predetermined orientation and installing and driving the screwing unit 3.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A tire assembly spanner, comprising:

a hollow handle being installed with a bending tube portion at one end thereof; another end of the handle being installed with a holding portion; a front end of the holding portion having a stop edge; an end of the bending tube portion far away from the handle having a resisting portion; a lateral side of the resisting portion having a through hole; a ring enclosing the resisting portion and the ring having a hole;

an engaging element being installed to one end of the resisting portion far away from the handle; one end of the engaging element having an engaging portion for receiving a sleeve; another end of the engaging element having a ratchet teeth portion corresponding to the resisting portion; a connection of the engaging element and the ratchet teeth portion being formed as a tapered portion; an inner side of the ratchet teeth portion being formed with ratchet teeth; an axial center of the engaging element having a groove for receiving a rotary portion;

the rotary portion defining a first end having an annular disk-shaped portion with another end of the rotary portion being reduced forming a shaft; a lateral side of the shaft being formed with a recess; a lateral side of the first end having a switch which is received in the through hole of the resisting portion and the hole of the ring;

a wheel having a penetrating axial hole for receiving the shaft; a lateral side of the wheel having a trench communicated to the axial hole for receiving a buckle; two ends of the buckle being formed with a first teeth and a second teeth; a side of the buckle facing to the trench being formed with two inclined surfaces; a control unit being installed between the buckle and the trench; the control unit being formed by a steel ball and an elastic body; the elastic body being installed within the recess of the shaft;

wherein the rotary potion and the wheel are installed in the resisting portion; by rotating the switch, the control unit swings so that the buckle rotates at different directions; and wherein by the buckle resisting against the ratchet teeth of the ratchet teeth portion, the spanner can be driven bi-directionally.

* * * * *